US011358818B2

(12) United States Patent
Yamaguchi et al.

(10) Patent No.: US 11,358,818 B2
(45) Date of Patent: Jun. 14, 2022

(54) CONTROL APPARATUS AND FEEDING APPARATUS

(71) Applicant: Duplo Seiko Corporation, Kinokawa (JP)

(72) Inventors: Taichi Yamaguchi, Kinokawa (JP); Tadahira Ohkochi, Kinokawa (JP); Akane Tokutake, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 99 days.

(21) Appl. No.: 16/930,380

(22) Filed: Jul. 16, 2020

(65) Prior Publication Data

US 2021/0016988 A1 Jan. 21, 2021

(30) Foreign Application Priority Data

Jul. 19, 2019 (JP) ..... JP2019-133637

(51) Int. Cl.
*B65H 7/16* (2006.01)
*B65H 3/48* (2006.01)
(Continued)

(52) U.S. Cl.
CPC ..... *B65H 7/16* (2013.01); *B65H 3/128* (2013.01); *B65H 3/48* (2013.01); *B65H 7/02* (2013.01); *B65H 2301/423* (2013.01); *B65H 2301/44735* (2013.01); *B65H 2406/322* (2013.01); *B65H 2515/212* (2013.01); *B65H 2551/26* (2013.01)

(58) Field of Classification Search
CPC . B65H 3/128; B65H 3/48; B65H 7/16; B65H 2301/423; B65H 2301/44735; B65H 2515/212
See application file for complete search history.

(56) References Cited

U.S. PATENT DOCUMENTS 7,823,875 B2 11/2010 Fukatsu et al.
7,913,993 B2 * 3/2011 Kosugi ..... B65H 3/48 271/98

(Continued)

FOREIGN PATENT DOCUMENTS

JP 4739084 B2 10/2007

OTHER PUBLICATIONS

Extended European Search Report issued in corresponding European Patent Application No. 20185876.8-1017, dated Jan. 12, 2021, (8 pages).

*Primary Examiner* — Jeremy R Severson
(74) *Attorney, Agent, or Firm* — Buchanan Ingersoll & Rooney PC

(57) ABSTRACT

The control apparatus includes an acquisition unit, an air volume setting unit, and an air blow control unit. The air volume setting unit sets a volume of air to be blown toward the plurality of sheets from a separation blower based on the information on the processing job acquired by the acquisition unit or by manipulation of a user. When the air volume is changed from a first air volume to a second air volume different from the first air volume by the user, the air volume setting unit maintains the air volume as the second air volume, irrespective of the information on the processing job acquired by the acquisition unit, until the air volume is changed from the second air volume to an air volume different from the second air volume by the user.

17 Claims, 5 Drawing Sheets

(51) Int. Cl.
*B65H 3/12* (2006.01)
*B65H 7/02* (2006.01)

(56) References Cited

U.S. PATENT DOCUMENTS

| | | | | |
|---|---|---|---|---|
| 8,210,518 | B2 | 7/2012 | Suzuki | |
| 2005/0040584 | A1* | 2/2005 | Isemura | B65H 3/48 271/97 |
| 2005/0184446 | A1 | 8/2005 | Takai et al. | |
| 2007/0228639 | A1 | 10/2007 | Matsumoto et al. | |
| 2009/0146363 | A1 | 6/2009 | Hosoi | |
| 2013/0127108 | A1* | 5/2013 | Shiraishi | B65H 3/54 271/11 |

* cited by examiner

CONTROL APPARATUS AND FEEDING APPARATUS

BACKGROUND OF THE INVENTION

Field of the Invention

The present invention relates to a control apparatus and a feeding apparatus that includes the control apparatus.

Description of the Related Art

Patent Document 1 discloses a sheet feeding apparatus including: a tray that is provided to be able to support and lift a plurality of sheets; a sheet separation fan provided in an air blowing unit configured to blow air for separating sheets supported by the tray toward the ends of the sheets; a revolution number detection section that detects the number of revolution of the sheet separation fan; and a control section that controls lifting and lowering operations of the tray and an operation of the sheet separation fan. The sheet feeding apparatus feeds the sheets one by one.

PRIOR ART DOCUMENT

Patent Document

Patent Document 1: Japanese Patent No. 4739084

SUMMARY OF THE INVENTION

In the sheet feeding apparatus, a user selects a material of a sheet via a display unit. Hence, in the sheet feeding apparatus, for example, every time a job is changed, the material of the sheet needs to be re-selected, which may result in a lack of convenience.

It is an object of the present invention to provide a control apparatus capable of enhancing convenience of a feeding apparatus, and a feeding apparatus including the control apparatus.

A control apparatus according to an aspect of the present invention is a control apparatus of a feeding apparatus that includes a feeding table on which a plurality of sheets are placeable, a separation blower that is disposed downstream of the feeding table in a conveying path extending from the feeding table toward a conveying direction intersecting with a placement direction of the plurality of sheets, the separation blower blowing air from a direction intersecting with the conveying direction toward the plurality of sheets to separate an uppermost sheet, which is disposed farthest from the feeding table in the placement direction of the plurality of sheets, among the plurality of sheets placed on the feeding table in the placement direction, and a sucking conveyer that is disposed with a gap formed in the placement direction with respect to the uppermost sheet in a state of not being separated by the separation blower, the sucking conveyer conveying the uppermost sheet separated by the separation blower along the conveying path while sucking the uppermost sheet. The control apparatus includes: an acquisition unit that acquires information on a processing job of the plurality of sheets; an air volume setting unit that sets a volume of air to be blown toward the plurality of sheets from the separation blower based on the information on the processing job acquired by the acquisition unit or by manipulation of a user; and an air blow control unit that controls the separation blower so as to blow air of the air volume set by the air volume setting unit toward the plurality of sheets. When the air volume is changed from a first air volume to a second air volume different from the first air volume by the user, the air volume setting unit maintains the air volume as the second air volume, irrespective of the information on the processing job acquired by the acquisition unit, until the air volume is set to an air volume different from the second air volume by the user.

A feeding apparatus according to an aspect of the present invention includes the feeding table, the separation blower, the sucking conveyer, and the control apparatus.

The control apparatus of the aspect includes: an acquisition unit that acquires information on a processing job of the plurality of sheets; an air volume setting unit that sets a volume of air to be blown toward the plurality of sheets from the separation blower based on the information on the processing job acquired by the acquisition unit or by manipulation of a user; and an air blow control unit that controls the separation blower so as to blow air toward the plurality of sheets at the air volume set by the air volume setting unit. When the air volume is changed from a first air volume to a second air volume different from the first air volume by the user, the air volume setting unit maintains the air volume as the second air volume, irrespective of the information on the processing job acquired by the acquisition unit, until the air volume is changed from the second air volume to an air volume different from the second air volume by the user. With such a configuration, for example, when the air volume of air that is blown to the plurality of sheets placed on the feeding table is preset in accordance with the type of the sheets, and when the user sets the second air volume different from the first air volume preset for the specific type of sheets, each time the sheets placed on the feeding table are changed to the specific type of sheets, the air of the second air volume is blown to the plurality of sheets without the user setting the second air volume from the first air volume. As a result, it is possible to achieve a control apparatus capable of enhancing the convenience of the feeding apparatus.

According to the feeding apparatus of the above aspect, a highly convenient feeding apparatus can be achieved by the control apparatus.

DESCRIPTION OF THE PREFERRED EMBODIMENT

Hereinafter, an example of the present disclosure will be described with reference to the accompanying drawings. In the following description, terms indicating specific directions or positions (e.g., terms including "up," "down," "right," "left," "front," and "rear") will be used as necessary, but the use of those terms is to facilitate understanding of the present disclosure with reference to the drawings, and the technical scope of the present disclosure is not limited by the meanings of these terms. The following description is essentially mere illustration and does not intend to restrict the present disclosure, its application, or its use. Further, the drawings are schematic, and the ratio of each dimension, or the like, does not necessarily match an actual one.

Figure 1:
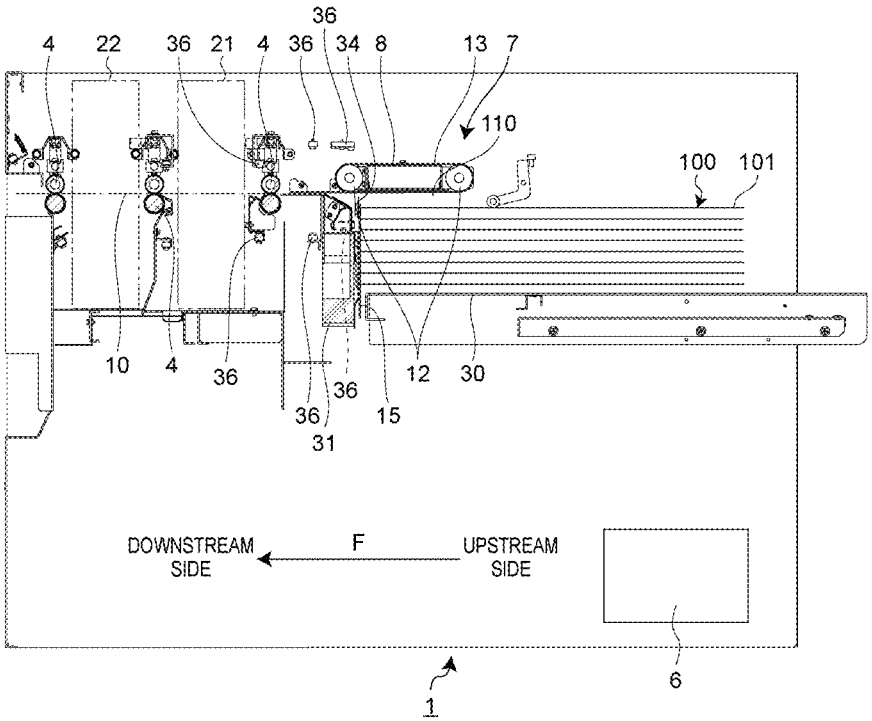
FIG. 1 is a schematic view illustrating an overall configuration of a sheet process apparatus that includes a feeding apparatus according to an embodiment of the present invention.

As illustrated in FIG. 1, a sheet process apparatus 1 of an embodiment of the present invention includes a feeding apparatus 7, a first processing apparatus 21, a second processing apparatus 22, a discharge tray (not illustrated), and a control apparatus 6.

In the following description, a downstream side in a conveying direction F of a sheet 100 is referred to as "front" or a "downstream side." An upstream side in the conveying direction F of the sheet 100 is defined as "rear" or an "upstream side." Upper and lower portions across a conveying path 10 are defined as an "upper side" and a "lower side." Further, a sheet width direction (i.e., a horizontal direction orthogonal to the conveying direction F) is defined as a "right-left direction," and "right" and "left" are defined based on a state where the sheet process apparatus 1 is viewed from rear.

As illustrated in FIG. 1, the feeding apparatus 7 has a feeding table 30, a separation blower 31, and a sucking conveyer 8. The feeding apparatus 7 is configured to feed a plurality of sheets 100 stacked on the feeding table 30 to a conveying path 10 one by one along the conveying direction F from the top.

Figure 2:
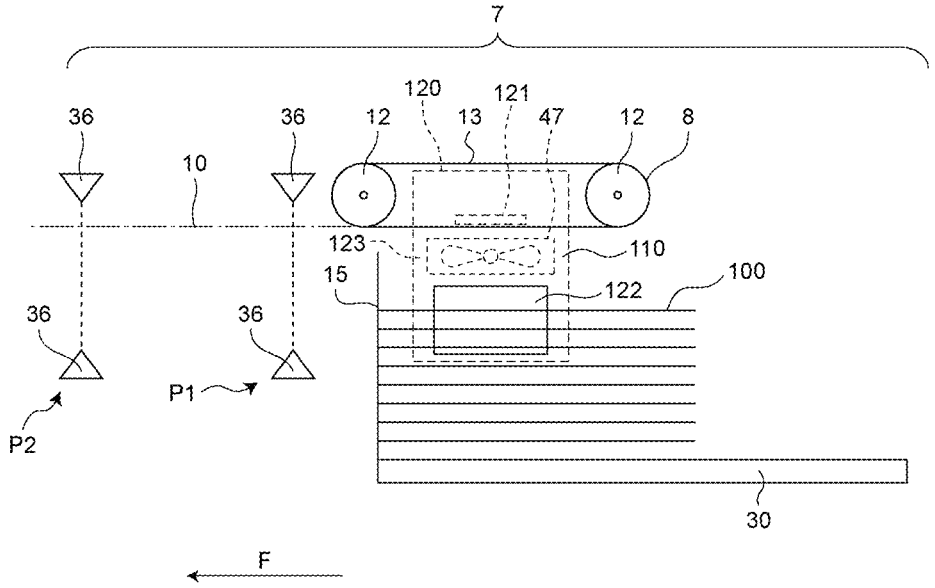
FIG. 2 is a schematic view of the feeding apparatus illustrated in FIG. 1.

The conveying path 10 extends from the feeding apparatus 7 to the discharge tray along the conveying direction F. As illustrated in FIG. 1, a plurality of conveying rollers 4 are disposed on the conveying path 10 so as to be spaced from each other. Each conveying roller 4 is made up of, a pair of roller parts arranged to be able to hold the sheet 100. As illustrated in FIG. 2, a sheet position detection sensor 36 is provided in the conveying path 10. In this embodiment, as an example, a plurality of the sheet position detection sensors 36 are provided.

As illustrated in FIG. 1, the feeding table 30 is configured so that a plurality of sheets 100 can be placed in a vertically stacked state. Each sheet 100 includes a resin sheet as well as a paper sheet.

A front stopper 15 is provided at a front end of the feeding table 30 in the conveying direction F. The front stopper 15 regulates movements of each sheet 100 in the conveying direction F to position each sheet 100 placed on the feeding table 30. A separation member 34 is provided at an upper end of the front stopper 15. When an uppermost sheet 101 separated by the air blow from the separation blower 31 is conveyed by the sucking conveyer 8, the separation member 34 prevents the sheet 100 lower than the uppermost sheet 101 from being conveyed together with the uppermost sheet 101. The uppermost sheet 101 is a sheet disposed farthest from the feeding table 30 in a vertical direction among the plurality of sheets 100 placed on the feeding table 30.

Figure 4:
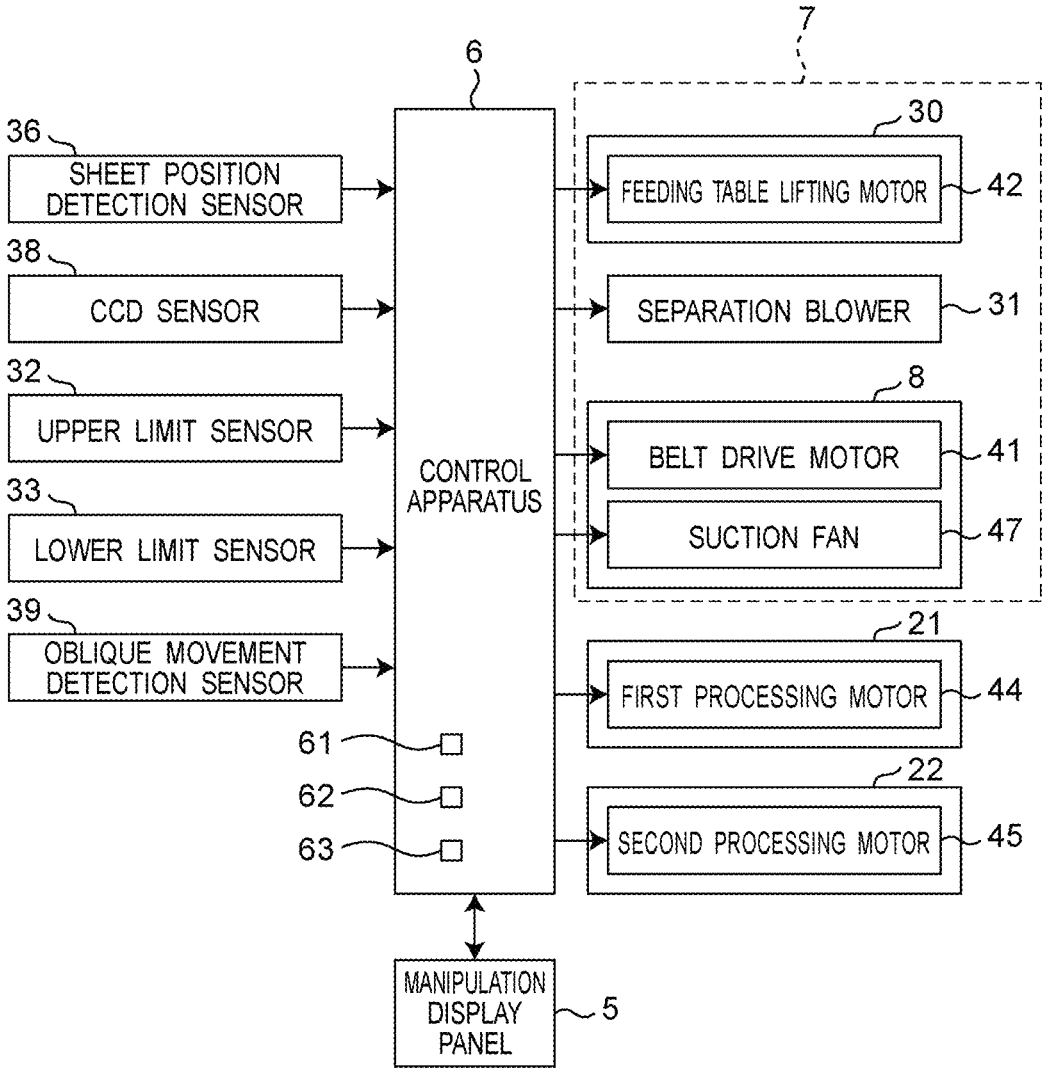
FIG. 4 is a block diagram illustrating a control apparatus of the feeding apparatus of FIG. 1.

The feeding table 30 is vertically movable by a feeding table lifting motor 42 (illustrated in FIG. 4). An upper limit sensor 32 (illustrated in FIG. 4) is disposed at an upper limit position in a moving rage of the feeding table 30. A lower limit sensor 33 (illustrated in FIG. 4) is disposed at a lower limit position in the moving range of the feeding table 30. The upper limit position is set so that the uppermost sheet 101 among the plurality of sheets 100 placed on the feeding table 30 can be sucked and conveyed by the sucking conveyer 8.

As illustrated in FIG. 1, the separation blower 31 is disposed downstream of the feeding table 30 in the conveying path 10. The conveying path 10 extends from the feeding table 30 toward the conveying direction F intersecting with the placement direction of the plurality of sheets 100 (i.e., the vertical direction). As an example, the separation blower 31 has a blower fan and is configured to be able to blow air toward the plurality of sheets 100 from the front in the conveying direction F. The uppermost sheet 101 among the plurality of sheets 100 placed on the feeding table 30 is vertically separated from the plurality of other sheets 100 by the air blow from the separation blower 31.

As illustrated in FIG. 1, the sucking conveyer 8 is disposed at the downstream end of the feeding table 30 in the conveying direction F with a gap 110 vertically formed with respect to the uppermost sheet 101 in a state of not being separated by the separation blower 31. The sucking conveyer 8 has annular belts 13, a belt, drive motor 41 (illustrated in FIG. 4), a suction box 120 (illustrated in FIG. 2) disposed in a space surrounded by the belts 13, and a suction fan 47 (illustrated in FIG. 2) disposed inside the suction box 120.

The belts 13 are disposed to be able to suck the uppermost sheet 101, while arranged in a direction orthogonal to the conveying direction F and the vertical direction (i.e., a direction of penetrating the paper of FIG. 1). Each belt 13 is extended between each pair of belt drive rollers 12 arranged separately in the conveying direction F, and driven by the belt drive motor 41 via the pair of belt drive rollers 12. That is, the pair of belt drive rollers 12 and the belt drive motor 41 constitute a drive unit for driving the belt 13.

Figure 3:
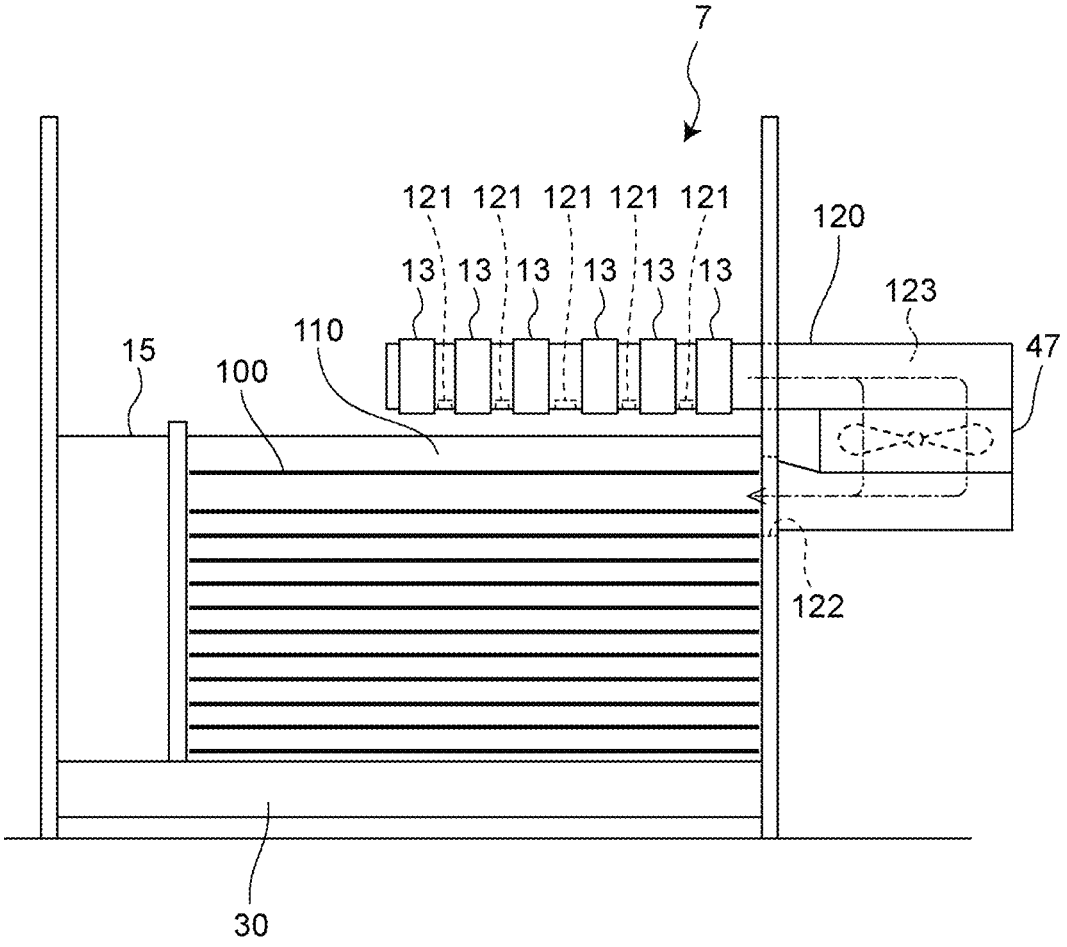
FIG. 3 is a schematic view of the feeding apparatus of FIG. 1 as viewed from an upstream in a conveying direction.

As illustrated in FIGS. 2 and 3, the suction box 120 has a suction port 121, a blowout port 122, and an air passage 123 connected to the suction port 121 and the blowout port 122. The suction port 121 is disposed to face the uppermost sheet 101 in the vertical direction. The blowout port 122 is disposed to face the plurality of sheets 100 in a direction intersecting with the conveying direction F and the vertical direction (i.e., in the right-left direction of FIG. 3). The air passage 123 is provided inside the suction box 120.

As illustrated in FIGS. 2 and 3, the suction fan 47 is disposed in the air passage 123 in the suction box 120. The suction fan 47 sucks the air outside of the suction box 120 (i.e., the air in the gap 110) to the air passage 123 through the suction port 121, sucks the uppermost sheet 101 toward the suction box 120, and blows the air in the air passage 123 toward the side edges of the plurality of sheets 100 through the blowout port 122.

That is, the sucking conveyer 8 is configured such that the uppermost sheet 101 separated by the separation blower 31 can be conveyed by the belt 13 along the conveying path 10 while being sucked to the belt 13 by the suction fan 47.

As illustrated in FIG. 1, the first processing apparatus 21 and the second processing apparatus 22 are sequentially disposed in the conveying direction F downstream of the feeding apparatus 7 in the conveying path 10. The first processing apparatus 21 and the second processing apparatus 22 have a first processing motor 44 (illustrated in FIG. 4) and a second processing motor 45 (illustrated in FIG. 4), respectively, and can perform predetermined processing on the sheet 100 fed from the feeding apparatus 7. Cutting wastage generated by the processing (e.g., cutting) of the sheet 100 is collected in a trash box (not illustrated) provided at the bottom of the sheet process apparatus 1.

The first processing apparatus 21 and the second processing apparatus 22 do not simply mean two processing apparatuses but are defined as a broad concept including two or more processing apparatuses. Each of the first processing apparatus 21 and the second processing apparatus 22 is, for example, a vertical cutting apparatus, a horizontal cutting apparatus, a vertical folding apparatus, a horizontal folding apparatus, a vertical perforation apparatus, a horizontal perforation apparatus, a rounding apparatus, an embossing apparatus, a printer, a pseudo adhesive apparatus, an adhesive apparatus, and a bookbinding apparatus, and is appropriately selected in accordance with the processing use of the sheet 100.

The control apparatus 6 includes, as an example, a central processing unit (CPU) that performs calculations and the like, and various memories such as a read only memory (ROM) and a random access memory (RAM) that store programs or data necessary for operating the sheet process apparatus 1. The control apparatus 6 controls the entire operation of the sheet process apparatus 1 including the feeding apparatus 7. More specifically, as illustrated in FIG. 4, the control apparatus 6 controls the feeding apparatus 7, the first processing apparatus 21, the second processing apparatus 22, and the like based on information on the processing job input by a user via an external terminal (not illustrated) such as an external computer connected to a manipulation display panel 5 or the control apparatus 6 by wire or wirelessly, and information detected by various sensors such as the sheet position detection sensor 36, a charge-coupled device (CCD) sensor 38, an upper limit sensor 32, a lower limit sensor 33, and an oblique movement detection sensor 39.

The sheet position detection sensor 36 has, for example, a transmission type photosensor in which a light-emitting element and a light-receiving element are disposed with the conveying path 10 sandwiched therebetween in the vertical direction. The sheet position detection sensor 36 detects whether the uppermost sheet 101 conveyed by the sucking conveyer 8 has arrived at reference positions P1, P2 (illustrated in FIG. 2) disposed downstream of the sucking conveyer 8 in the conveying path 10.

The CCD sensor 38 is, for example, a sensor configured to be able to read a bar code or the like formed on the sheet 100. For example, by storing information on a processing job in a bar code and reading the bar code with the CCD sensor 38, it is possible to automatically make a setting related to the processing job.

The oblique movement detection sensor 39 is, for example, a transmission type photosensor having a pair of a light-emitting element and a light-receiving element disposed to face each other across the conveying path 10, and detects whether the sheet 100 has been conveyed obliquely.

The control apparatus 6 has an acquisition unit 61, an air volume setting unit 62, and an air blow control unit 63. Each of the acquisition unit 61, the air volume setting unit 62, and the air blow control unit 63 is achieved by the CPU executing a predetermined program.

The acquisition unit 61 acquires information serving as an index of air volume setting of the separation blower 31 from information input by the user via the manipulation display panel 5 or information read by the CCD sensor 38, for example. This information constitutes, for example, a part of the information on the processing job of each sheet 100 placed on the feeding table 30. That is, the acquisition unit 61 acquires information on the processing job of each sheet 100 including index information serving as an index for setting the air volume of the separation blower 31. The information on the processing job may include, as index information, at least one of the type of each sheet 100, the size of each sheet 100, and the air volume of air that is blown toward the plurality of sheets 100 placed on the feeding table 30 (i.e., information on the airflow). In addition to the index information, the information on the processing job may include, for example, a type of processing to be performed on the sheet 100, an arrangement, quantity, and dimensions of a product (e.g., a printed portion). The type of the sheet 100 means a group classified by at least one of the following concepts: basis weight, a sheet type such as resin sheet, high-quality paper sheet, laminated paper, coated paper (e.g., ultraviolet (UV) coated paper) sheet, a frictional resistance value of the sheet surface, susceptibility to static electricity, and a curl amount (i.e., a degree of curvature of the sheet), for example.

The information on the processing job can be stored in a storage unit (not illustrated) of the control apparatus 6 of the sheet process apparatus 1 or in a storage unit (not illustrated) of an external terminal such as an external computer connected to the control apparatus 6 by wire or wirelessly. In this case, the user can automatically set the processing job by calling information on a desired processing job from the storage unit of the control apparatus 6 or the external terminal.

The air volume setting unit 62 sets the volume of air that is blown from the separation blower 31 toward the plurality of sheets 100 placed on the feeding table 30. The air volume is set, for example, based on information acquired by the acquisition unit 61 (i.e., the information on the processing job) or by the user's manipulation performed via the manipulation display panel 5.

Specifically, the air volume setting unit 62 determines whether the air volume has been set by the user via the manipulation display panel 5. When the air volume has been set by the user, the air volume set by the user is set as the volume of air that is blown from the separation blower 31. On the other hand, when the air volume has not been set by the user, it is determined whether the information on the air volume is included in the information acquired by the acquisition unit 61. When the information acquired by the acquisition unit 61 includes the information on the air volume, the air volume included in the information acquired by the acquisition unit 61 is set as the volume of air that is blown from the separation blower 31. When the information acquired by the acquisition unit 61 does not include the information on the air volume, for example, the air volume is calculated based on the information acquired by the acquisition unit 61 (e.g., the type or size of sheet 100), and the calculated air volume is set as the volume of air that is blown from the separation blower 31.

In other words, when the air volume is changed from a first air volume to a second air volume different from the first air volume by the user, the air volume setting unit 62 maintains the air volume as the second air volume, irrespective of the Information acquired by the acquisition unit 61, until the air volume is changed from the second air volume to an air volume different from the second air volume by the user.

The air volume set by the user may be stored in the storage unit (not illustrated) of the control apparatus 6 or may be stored in a storage unit (not illustrated) of an external terminal such as an external computer connected to the control apparatus 6 by wire or wirelessly. When settings related to various processing jobs are made by the user, information on the air volume as index information included in information on the processing jobs may be stored into the storage unit of the control apparatus 6 or the external terminal.

The air volume setting unit 62 increases the air volume when the sheet position detection sensor 36 does not detect the arrival of the uppermost sheet 101 at the reference positions P1, P2 after the sucking conveyer 8 is driven. When the sheet position detection sensor 36 does not detect the arrival of the uppermost sheet 101 at the reference positions P1, P2 even though the sucking conveyer 8 is driven, it is expected that the uppermost sheet 101 is not sufficiently separated from the other sheets 100 and is in a non-fed state. In such a case, the volume of air that is blown from the separation blower 31 is temporarily made larger than the set air volume, and the uppermost sheet 101 is separated from the other sheets 100 more reliably, thereby resolving the non-fed state of the sheet 100.

An increase value of the air volume in this case is determined based on, for example, the information on the processing job acquired by the acquisition unit 61 (e.g., type and size of sheet 100). When the sheet position detection sensor 36 detects the arrival of the uppermost sheet 101 at the reference positions P1, P2 after a temporary increase of the air volume, the air volume setting unit 62 reduces the volume of air that is blown from the separation blower 31 to return to the set air volume.

The air volume setting unit 62 reduces the air volume when the uppermost sheet 101 is sucked to the belt 13. When the volume of air that is blown from the separation blower 31 is left as it is even though the uppermost sheet 101 has been sucked to the belt 13, there is a possibility that the next uppermost sheet 101 is separated by the air blow from the separation blower 31 and blown up, and the plurality of sheets 100 (i.e., the first uppermost sheet 101 sucked to the belt 13 and the next uppermost sheet 101 separated and blown up) are conveyed by the sucking conveyer 8 in a stacked state (i.e., fed in a stacked manner). Therefore, when the uppermost sheet 101 is sucked to the belt 13, the air volume is reduced, thereby reducing the possibility that the sheets 100 are fed in a stacked manner.

Whether the uppermost sheet 101 has been sucked to the belt 13 may be determined, for example, based on whether a predetermined time (e.g., three seconds) has elapsed since a start of driving the suction fan 47, or may be determined based on whether the sucking of the uppermost sheet 101 to the belt is detected by a sensor that detects the sucking of the uppermost sheet 101 to the belt 13.

The air volume setting unit 62 changes the air volume to a third air volume larger than zero and smaller than an air volume that is set at the time of separating the uppermost sheet 101 (i.e., the first air volume and the second air volume) during standby of the sucking conveyer 8. In the sheet process apparatus 1, the third air volume is such a minute air volume that the uppermost sheet 101 is not separated by the air blow from the separation blower 31. As described above, even in the standby state where the sucking conveyer 8 is not operating, the separation blower 31 is kept in operation to shorten a standby time when the feeding apparatus 7 is shifted from the standby state to the operating state.

The air blow control unit 63 controls the separation blower 31 so as to blow air toward the plurality of sheets 100 at the air volume set by the air volume setting unit 62. The air blow control unit 63 controls the separation blower 31 so as to blow air toward the plurality of sheets 100 at the third air volume even when the sucking conveyer 8 is in standby. As an example, the separation blower 31 is controlled by pulse width modulation (PWM) control.

Next, a process of setting the volume of air that is blown from the separation blower 31 will be described with reference to FIG. 5. A process described below is performed by the control apparatus 6 executing a predetermined program.

Figure 5:
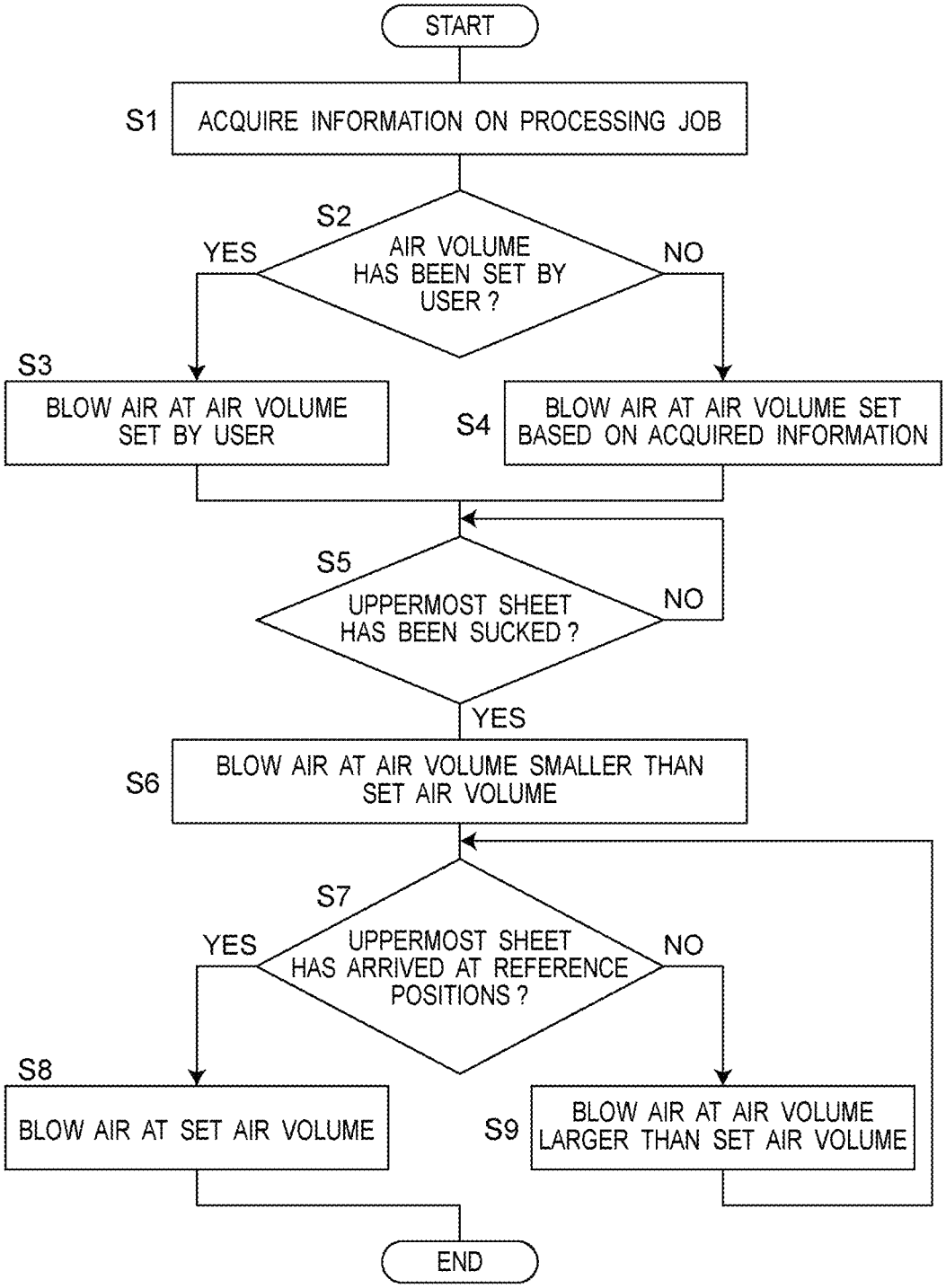
FIG. 5 is a flowchart for explaining an air volume setting process in the feeding apparatus illustrated in FIG. 1.

As illustrated in FIG. 5, the acquisition unit 61 acquires information on the processing job (step S1), and the air volume setting unit 62 determines whether the air volume has been set by the user via the manipulation display panel 5 (step S2).

When it is determined that the air volume has been set by the user, the air volume setting unit 62 sets the air volume set by the user as the volume of air that is blown from the separation blower 31. Then, the air blow control unit 63 controls the separation blower 31 so as to blow air toward the plurality of sheets 100 at the air volume set by the user (step S3).

On the other hand, when it is determined that the air volume has not been set by the user, the air volume setting unit 62 sets the air volume based on the information acquired by the acquisition unit 61. Then, the air blow control unit 63 controls the separation blower 31 so as to blew air toward the plurality of sheets 100 at the air volume set based on the information acquired by the acquisition unit 61 (step S4).

When the air blow of the separation blower 31 to the plurality of sheets 100 is started, the air volume setting unit 62 determines whether the uppermost sheet 101 has been sucked to the belt 13 (step S5). When it is not determined that the uppermost sheet 101 has been sucked to the belt 13, step S5 is repeated until it is determined that the uppermost sheet 101 has been sucked to the belt 13.

When it is determined that the uppermost sheet 101 has been sucked to the belt 13, the air volume setting unit 62 reduces the set air volume, and the air blow control unit 63 controls the separation blower 31 so as to blow air toward the plurality of sheets 100 with the reduced air volume (step 36).

When the uppermost sheet 101 is sucked to the belt 13 and the belt 13 is driven, the control apparatus 6 determines whether the sheet position detection sensor 36 has detected the arrival of the uppermost sheet 101 at the reference positions P1, P2 (step S7).

When it is determined that the sheet position detection sensor 36 has detected the arrival of the uppermost sheet 101 at the reference positions P1, P2, the air blow control unit 63 controls the separation blower 31 so as to blow air toward the plurality of sheets 100 at the set air volume (step S8).

On the other hand, when it is determined that the sheet position detection sensor 36 has not detected the arrival of the uppermost sheet 101 at the reference positions P1, P2, the air volume setting unit 62 increases the set air volume. Then, the air blow control unit 63 controls the separation blower 31 so as to blow air toward the plurality of sheets 100 at the increased air volume (step S9). Thereafter, the process returns to step S7 again, and it is determined again whether the sheet position detection sensor 36 has detected the arrival of the uppermost sheet 101 at the reference positions P1, P2. When it is determined that the sheet position detection sensor 36 has detected the arrival of the uppermost sheet 101 at the reference positions P1, P2, the air volume setting unit 62 returns the increased air volume to the set air volume. The air blow control unit 63 controls the separation blower 31 so as to blow air toward the plurality of sheets 100 at the set air volume (step S9).

As described above, the control apparatus 6 includes: the acquisition unit 61 that acquires information on a processing job of the plurality of sheets 100; the air volume setting unit 62 that sets a volume of air to be blown toward the plurality of sheets 100 from the separation blower 31 based on the information on the processing job acquired by the acquisition unit 61 or by manipulation of the user; and the air blow control unit 63 that controls the separation blower 31 so as to blow air toward the plurality of sheets 100 at the air volume set by the air volume setting unit 62. When the air volume is changed from a first air volume to a second air volume different from the first air volume by the user, the air volume setting unit 62 maintains the air volume as the second air volume, irrespective of the information on the processing job acquired by the acquisition unit, until the air volume is changed from the second air volume to an air volume different from the second air volume by the user. With such a configuration, for example, when the air volume of air that is blown to the plurality of sheets 100 placed on the feeding table 30 is preset in accordance with the type of the sheets 100, and when the user sets the second air volume different from the first air volume preset for the specific type of sheets 100, each time the sheets 100 placed on the feeding table are changed to the specific type of sheets, the air of the second air volume is blown to the plurality of sheets 100 without the user setting the second air volume from the first air volume. As a result, it is possible to achieve the control apparatus 6 capable of enhancing the convenience of the feeding apparatus 7.

"When the air volume is changed from the second air volume to an air volume different from the second air volume by the user" includes, for example, a case where the air volume set by the user is cancelled and the air volume comes into a state of not being set by the user.

The air volume setting unit 62 increases the air volume when the sheet position detection sensor 36 does not detect the arrival of the uppermost sheet 101 at the reference positions P1, P2 after the sucking conveyer 8 is driven. With such a configuration, when the possibility of idling of the sheet 100 is considered, the uppermost sheet 101 is separated from the other sheets 100 more reliably, so that the non-fed state of the sheet 100 can be eliminated even in the case of idling of the sheet 100.

The air volume setting unit 62 reduces the air volume when the uppermost sheet 101 is sucked to the belt 13. With such a configuration, it is possible to prevent the sheet 100 from being fed in a stacked manner.

The air volume setting unit 62 changes the air volume to a third air volume larger than zero and smaller than the first air volume and the second air volume during the standby of the sucking conveyer 8. With such a configuration, it is possible to shorten a standby time when the feeding apparatus 7 is changed from the standby state to the operating state.

The control apparatus 6 can achieve the highly convenient feeding apparatus 7.

The sucking conveyer 8 of the feeding apparatus 7 includes the suction box 120 and the suction fan 47. The suction box 120 has the suction port 121 disposed to face the uppermost sheet 101 in the placement direction, the blowout port 122 disposed to face the plurality of sheets 100 in a direction intersecting with the conveying direction F and the placement direction, and the air passage 123 connected to each of the suction port 121 and the blowout port 122. The suction fan 47 is disposed in the air passage 123, sucking air outside the suction box 120 (i.e., air in the gap 110) into the air passage 123 through the suction port 121 to suck the uppermost sheet 101 toward the suction box 120, and blowing air in the air passage 123 toward the side edges of the plurality of sheets 100 through the blowout port 122. With such a configuration, the air is blown toward the plurality of sheets 100 of the feeding table 30 from the suction fan 47 in addition to the separation blower 31, so that the uppermost sheet 101 can be separated from the plurality of other sheets 100 more reliably. The use of the suction fan 47 eliminates the need to provide an independent blower fan configured to blow air from the blowout port 122 toward the side edges of the plurality of sheets 100, whereby the manufacturing cost of the feeding apparatus 7 can be reduced.

Each of the feeding table 30, the separation blower 31, and the sucking conveyer 3 constituting the feeding apparatus 7 is not limited to the embodiment described above but can be changed as appropriate in accordance with the design of the feeding apparatus 7 or the sheet process apparatus 1, or the like.

For example, any one or more than one of the various sensors, including the sheet position detection sensor 36, may be omitted, or different sensors may be added.

The blowout port 122 of the suction box 120 is not limited to the case of being disposed to face the plurality of sheets 100 in the direction intersecting with the conveying direction F and the placement direction but may be disposed at a position not facing the plurality of sheets 100, for example.

The air volume setting unit 62 may be configured to maintain the air volume as the second air volume different from the first air volume when the air volume is changed by the user from the first air volume to the second air volume, irrespective of the information acquired by the acquisition unit 61, until the air volume is changed from the second air volume to an air volume different from the second air volume by the user. That is, the air volume setting unit 62 may not foe configured to increase the air volume when the sheet position detection sensor 36 does not detect the arrival of the uppermost sheet 101 at the reference positions P1, P2 after the sucking conveyer 8 is driven, or may not be configured to reduce the air volume when the uppermost sheet 101 is sucked to the belt 13, or may not be configured to change the air volume to the third air volume which is larger than zero and smaller than the first air volume and the second air volume during the standby of the sucking conveyer 8.

By appropriately combining any of the various embodiments or modifications described above, the effects of the respective embodiments or modifications can be achieved. In addition, a combination of embodiments, a combination of examples, or a combination of an embodiment and an example is possible, and a combination of features in different embodiments or examples is also possible.

According to the present invention, it is possible to provide a control apparatus capable of enhancing the convenience of a feeding apparatus and provide a feeding apparatus including the control apparatus, and hence the industrial utility values of the apparatuses are high.

REFERENCE SIGNS LIST

1. sheet process apparatus
4. conveying roller
5. manipulation display panel
6. control apparatus
7. feeding apparatus
8. sucking conveyer
10. conveying path
12. belt drive roller
13. belt
15. front stopper
21. first processing apparatus
22. second processing apparatus
30. feeding table
31. separation blower
32. upper limit sensor

33. lower limit sensor
34. separation member
36. sheet position detection sensor
38. charge-coupled device sensor
39. oblique movement detection sensor
41. belt drive motor
42. feeding table lifting motor
44. first processing motor
45. second processing motor
47. suction fan
61. acquisition unit
62. air volume setting unit
63. air blow control unit
100. sheet
101. uppermost sheet
110. gap
120. suction box
121. suction port
122. blowout port
123. air passage
F. conveying direction
P1, P2 reference position

The invention claimed is:

1. A control apparatus of a feeding apparatus that includes a feeding table on which a plurality of sheets are placeable, a separation blower that is disposed downstream of the feeding table in a conveying path extending from the feeding table toward a conveying direction intersecting with a placement direction of the plurality of sheets, the separation blower blowing air from the conveying direction toward the plurality of sheets to separate an uppermost sheet, which is disposed farthest from the feeding table in the placement direction of the plurality of sheets, among the plurality of sheets placed on the feeding table in the placement direction, and a sucking conveyer that is disposed with a gap formed in the placement direction with respect to the uppermost sheet in a state of not being separated by the separation blower, the sucking conveyer conveying the uppermost sheet separated by the separation blower along the conveying path while sucking the uppermost sheet, the control apparatus comprising:

an acquisition unit that acquires information on a processing job of the plurality of sheets;

an air volume setting unit that sets a volume of air to be blown toward the plurality of sheets from the separation blower based on the information on the processing job acquired by the acquisition unit or by manipulation of a user; and an air blow control unit that controls the separation blower so as to blow air toward the plurality of sheets at the air volume set by the air volume setting unit, wherein when the air volume is changed from a first air volume to a second air volume different from the first air volume by the user, the air volume setting unit maintains the air volume as the second air volume, irrespective of the information on the processing job acquired by the acquisition unit, until the air volume is changed from the second air volume to an air volume different from the second air volume by the user.

2. The control apparatus according to claim 1, wherein the feeding apparatus further includes a sheet position detection sensor that detects arrival of the uppermost sheet conveyed by the sucking conveyer at a reference position disposed downstream of the sucking conveyer in the conveying path, and the air volume setting unit increases the air volume when the sheet position detection sensor does not detect the arrival of the uppermost sheet at the reference position after the sucking conveyer is driven.

3. The control apparatus according to claim 2, wherein the sucking conveyer includes a belt on which the uppermost sheet is disposed to be able to be sucked and that conveys the uppermost sheet in a sucked state along the conveying path, and a drive unit that drives the belt, and the air volume setting unit reduces the air volume when the uppermost sheet is sucked by the belt.

4. The control apparatus according to claim 3, wherein the air volume setting unit changes the air volume to a third air volume larger than zero and smaller than the first air volume and the second air volume during standby of the sucking conveyer.

5. A feeding apparatus comprising:

the feeding table;

the separation blower;

the sucking conveyer; and the control apparatus according to claim 4.

6. A feeding apparatus comprising:

the feeding table;

the separation blower;

the sucking conveyer; and the control apparatus according to claim 3.

7. The control apparatus according to claim 2, wherein the air volume setting unit changes the air volume to a third air volume larger than zero and smaller than the first air volume and the second air volume during standby of the sucking conveyer.

8. A feeding apparatus comprising:

the feeding table;

the separation blower;

the sucking conveyer; and the control apparatus according to claim 7.

9. A feeding apparatus comprising:

the feeding table;

the separation blower;

the sucking conveyer; and the control apparatus according to claim 2.

10. The control apparatus according to claim 1, wherein the sucking conveyer includes a belt on which the uppermost sheet is disposed to be able to be sucked and that conveys the uppermost sheet in a sucked state along the conveying path, and a drive unit that drives the belt, and the air volume setting unit reduces the air volume when the uppermost sheet is sucked by the belt.

11. The control apparatus according to claim 10, wherein the air volume setting unit changes the air volume to a third air volume larger than zero and smaller than the first air volume and the second air volume during standby of the sucking conveyer.

12. A feeding apparatus comprising:

the feeding table;

the separation blower;

the sucking conveyer; and the control apparatus according to claim 11.

13. A feeding apparatus comprising:

the feeding table;

the separation blower;

the sucking conveyer; and the control apparatus according to claim 10.

14. The control apparatus according to claim 1, wherein the air volume setting unit changes the air volume to a third air volume larger than zero and smaller than the first air volume and the second air volume during standby of the sucking conveyer.

15. A feeding apparatus comprising:

the feeding table;

the separation blower;

the sucking conveyer; and the control apparatus according to claim 14.

16. A feeding apparatus comprising:

the feeding table;

the separation blower;

the sucking conveyer; and the control apparatus according to claim 1.

17. The feeding apparatus according to claim 16, wherein the sucking conveyer includes a suction box having a suction port disposed to face the uppermost sheet in the placement direction, a blowout port disposed to face the plurality of sheets in a direction intersecting with the conveying direction and the placement direction, and an air passage connected to each of the suction port and the blowout port, and a suction fan disposed in the air passage, sucking air outside the suction box into the air passage through the suction port to suck the uppermost sheet toward the suction box, and blowing air in the air passage toward the plurality of sheets through the blowout port.

* * * * *